US005947450A

United States Patent [19]

Grapes

[11] Patent Number: 5,947,450

[45] Date of Patent: Sep. 7, 1999

[54] MANUAL SWIVEL WINCH WITH OPEN BOTTOM

[76] Inventor: David B. Grapes, 39 Creighton Ave., Pittsburgh, Pa. 15205

[21] Appl. No.: 08/797,789

[22] Filed: Feb. 7, 1997

[51] Int. Cl.[6] ..... B66D 1/00

[52] U.S. Cl. ..... 254/329; 254/332; 242/398

[58] Field of Search ..... 254/329, 345, 254/343, 332; 242/398

[56] References Cited

U.S. PATENT DOCUMENTS

| | | | |
|---|---|---|---|
| 789,500 | 5/1905 | Lihou et al. | 254/343 |
| 1,306,721 | 6/1919 | Rose | 254/343 |
| 1,353,238 | 9/1920 | Holmes | 254/343 |
| 1,833,484 | 11/1931 | Geer | 254/343 |
| 2,678,191 | 5/1954 | Jensen | 254/343 X |
| 4,566,674 | 1/1986 | Ebey et al. | 254/345 |
| 4,603,839 | 8/1986 | Ekman et al. | 254/329 |
| 4,613,273 | 9/1986 | Wagner | 254/343 X |
| 5,320,572 | 6/1994 | Chen | 254/345 X |

OTHER PUBLICATIONS

Nashville Bridge Company brochure; "Mini–Profile Hand Winch 40 Ton"; Aug. 1991.

W. W. Patterson Company brochure; "40 Ton Low–Profile Model M40S Swivel Barge Connector"; Jan. 1996.

*Primary Examiner*—Donald P. Walsh
*Assistant Examiner*—Emmanuel M. Marcelo
*Attorney, Agent, or Firm*—Webb Ziesenheim Bruening Logsdon Orkin & Hanson, P.C.

[57] ABSTRACT

A manual swivel winch is pivotally attached to a D-ring of a barge deck, boat deck or the like. The manual swivel winch includes a pair of spaced side plates defining a substantially open bottom, a drum rotatably supported between the side plates, and a rotatable handle attached to the drum and extending from one of the side plates. A swivel link is attached to the side plates for pivotally attaching the winch to the D-ring. Each side plate may include a pair of spaced feet extending down at a lower edge thereof with a recess extending between the pair of feet. The recess combined with the open bottom provides a self-cleaning action to the manual swivel winch.

18 Claims, 7 Drawing Sheets

MANUAL SWIVEL WINCH WITH OPEN BOTTOM

BACKGROUND OF THE INVENTION

1. Field of the Invention

The present invention relates to winches, more particularly, the present invention relates to manual swivel winches.

2. Background Information

Winches have been used in many applications. Manual swivel winches have been widely used in barges, tow boats and the like. Typically a manual swivel winch is pivotally attached to a D-ring on a boat deck and spools a towing cable on a rotatable drum. These winches often are exposed to an abrasive environment and can become immersed in coal, ore or other material being transported. Consequently, these winches have a sturdy construction.

The sturdy construction of the prior art manual swivel winches resulted in a design with a relatively large number of manufacturing steps and a corresponding high labor cost for assembling the product. The prior art design also utilizes excess material increasing the material or capital costs of the product. Additionally, the prior art winch is not designed for easy cleaning.

The difficulties with the prior art design are highlighted by reviewing the construction and manufacturing of a prior art manual swivel winch 10 shown in FIGS. 1–3. The winch 10 of the prior art includes a base plate 12 and a pair of spaced side plates 14 surrounding a rotatable spool assembly. The rotatable spool assembly is rotatably supported between the side plates 14 and includes a drum 16, a protecting flange 18 on one side of the drum 16 and a controlling gear 20 on the other side of the drum 16. A control assembly 22 is supported by the side plates 14 and engages with the gear 20 to rotate the drum 16 for spooling of a cable (not shown) thereon. The control assembly 22 extends through one side plate 14 and includes a hand wheel 24 and an actuating lever 26 which are used for manually operating the winch 10. A foot brake 28 is attached to the side plate 14 through which the control assembly 22 extends. The foot brake 28 is adapted to frictionally engage the hand wheel 24. A swivel link 30 is attached to the base plate 12 at a rear of the winch 10 and pivotally attaches the winch 10 to a D-ring 32 of a boat deck or the like. A step or foot 34 is attached to the underside of the base plate 12 near a forward portion of the winch 10. A gear guard 36 is attached to one of the side plates 14 on the same side as the gear 20 and is positioned in a cutout formed in the side plate 14. The gear guard 36 prevents the cable from interfering with or becoming wrapped behind the gear 20. Similarly, a flange guard 37 is attached to the other side plate 14 in a cutout formed therein. The flange guard 37 prevents the cable from being wrapped behind the flange 18.

The construction of the manual swivel winch 10 includes the use of four tubular spacers 38 for spacing the side plates 14 apart. A bolt 40 extends through the center of each spacer 38 through aligned holes in the opposed side plates 14 and is secured by nuts 42. Two of the four spacers 38 are illustrated in FIGS. 1–3, one in the upper front portion of the winch 10 and the other in the upper rear portion of the winch 10. A third spacer 38 is provided in the lower rear portion of the winch 10 generally where the foot brake 28 is attached to one of the side plates 14. The fourth spacer 38 is originally positioned through holes 44 in the lower front portion of the side plates 14. During manufacturing of the winch 10, after attachment of the base plate 12, the fourth spacer 38 is removed to avoid interference with the cable. The swivel link 30 is attached to the base plate 12 by bolts 46 threaded into tapped holes 48 formed in the base plate 12. The manufacturing of the winch 10 further includes the welding of the base plate 12 to each of the side plates 14, the welding of the foot 34 to the underside of the base plate 12, the creation of the cutouts for the gear guard 36 and the flange guard 37 and the welding of the gear guard 36 and the flange guard 37 to the respective side plate 14.

The above description illustrates that the manufacture of the winch 10 is labor-intensive. The extensive heavy welding of the base plate 12, the tapping of holes 48, the welding of the gear guard 36, the flange guard 37 and the foot 34, and the subsequent removal of the fourth spacer 38 create a labor-intensive assembly operation. The design of the winch 10 also utilizes excess material increasing capital costs of the winch 10.

It is an object of the present invention to overcome the aforementioned drawbacks of the prior art. It is a further object of the present invention to provide a manual swivel winch which minimizes the manufacturing steps and the associated manufacturing time. It is another object of the present invention to provide a manual swivel winch which minimizes the material utilized in construction. It is another object of the present invention to provide a self-cleaning or easy-to-clean manual swivel winch.

SUMMARY OF THE INVENTION

The above-stated objects are achieved with the manual swivel winch of the present invention. The winch includes a pair of spaced side plates defining a substantially open bottom, a drum rotatably supported between the side plates, and a mechanism attached to the drum for rotation of the drum.

One embodiment of the manual swivel winch of the present invention further includes a swivel link attached to the side plates for pivotally attaching the winch to a D-ring. Each side plate may include a pair of spaced feet extending down at a lower edge thereof with a recess extending between the pair of feet. The recess combined with the open bottom provides a self-cleaning action to the winch. One of the pair of feet of each side plate may extend lower than the other of the pair of feet of the side plate with at least one of the feet assisting in placement of the winch. The winch may provide that the swivel link is bolted to the side plates avoiding the use of tapped holes. The side plates may be spaced from each other by a plurality of spacers and the swivel link, wherein one spacer is aligned with one of the pair of feet of each side plate. The use of the swivel link as a spacer minimizes the number of spacers required. The placement of one spacer aligned with a foot of each side plate allows the spacer to be left in position after construction. The winch of the present invention may further include an angle iron extending along one edge of each side plate with the angle iron forming a gear or flange guard for the winch. Additionally, each of the side plates may include a cutout extending to an edge of the side plate, wherein each cutout is adapted to receive a portion of the D-ring therein during pivoting of the winch.

These and other advantages of the present invention will be clarified in the description of the preferred embodiment taken together with the attached figures wherein like reference numerals represent like elements throughout.

BRIEF DESCRIPTION OF THE DRAWINGS

The present invention is described in connection with the attached figures, wherein.

DESCRIPTION OF THE PREFERRED EMBODIMENT

Figure 1:
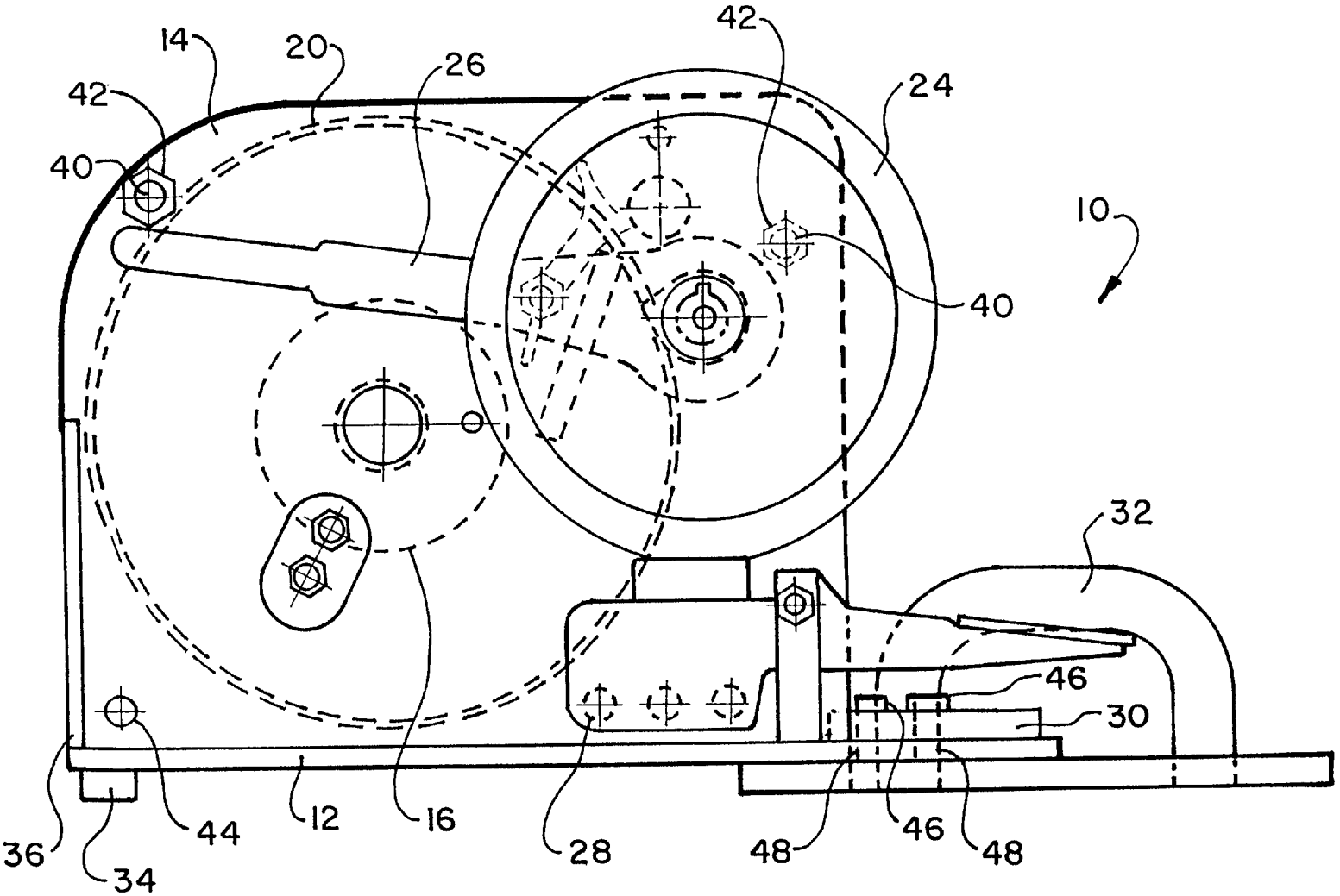
FIG. 1 PRIOR ART
FIG. 1 is a side view of a manual swivel winch according to the prior art.

FIGS. 4–8 illustrate a manual swivel winch 50 according to the present invention. The winch 50 includes a pair of spaced side plates 54 defining an open bottom. A rotatable spool assembly is rotatably supported between the side plates 54 and is the same spool assembly discussed above in connection with winch 10. The spool assembly includes the drum 16, the protecting flange 18 on one side of the drum 16 and the controlling gear 20 on the other side of the drum 16. A control assembly 22 is supported by the side plates 54 and is the same control assembly 22 discussed above in connection with winch 10. The control assembly 22 engages with the controlling gear 20 to rotate the drum 16 for spooling of a cable (not shown) thereon. The control assembly 22 extends through one side plate 54 and includes a hand wheel 24 and an actuating lever 26 which are used for manually operating the winch 10 in a conventional fashion. A foot brake 28 is attached to the side plate 54 through which the control assembly 22 extends. The foot brake 28 is the same structure as the foot brake 28 discussed above in connection with winch 10 and is adapted to frictionally engage the hand wheel 24 in a conventional fashion.

A swivel link 60 is attached to the pair of side plates 54 at a rear of the winch 50 and pivotally attaches the winch 50 to a D-ring 32 of a barge deck, a boat deck or the like. A three-quarters rear foot 62 is formed integral with each side plate 54 near a rear of the winch 50. A front foot 64 is formed integral with each side plate 54 at a forward portion of the winch 50. A cutout 63 extends from each front foot 64 to the forwardmost edge of the side plate 54. The three-quarters rear foot 62, which is provided to both assist in mounting the winch 50 on the D-ring 32 and provide material support to the side plate 54 for the attachment of the swivel link 60, does not extend as far down as the front foot 64. A recess 65 is formed in each side plate 54 between the front foot 64 and the rear foot 62. A gear guard 66 is attached to an inner side of one of the side plates 54 on the same side of the spool assembly as the gear 20. The gear guard 66 extends down to the cutout 63 and functions substantially the same as gear guard 36 of winch 10 and will prevent the cable from interfering with or becoming wrapped behind the gear 20. Similarly, a flange guard 67 is attached to the other side plate 54 on an inside surface thereof extending down to the cutout 63 in the other side plate 54. The flange guard 67, similar to flange guard 37, prevents the cable from being wrapped behind the flange 18.

Figure 2:
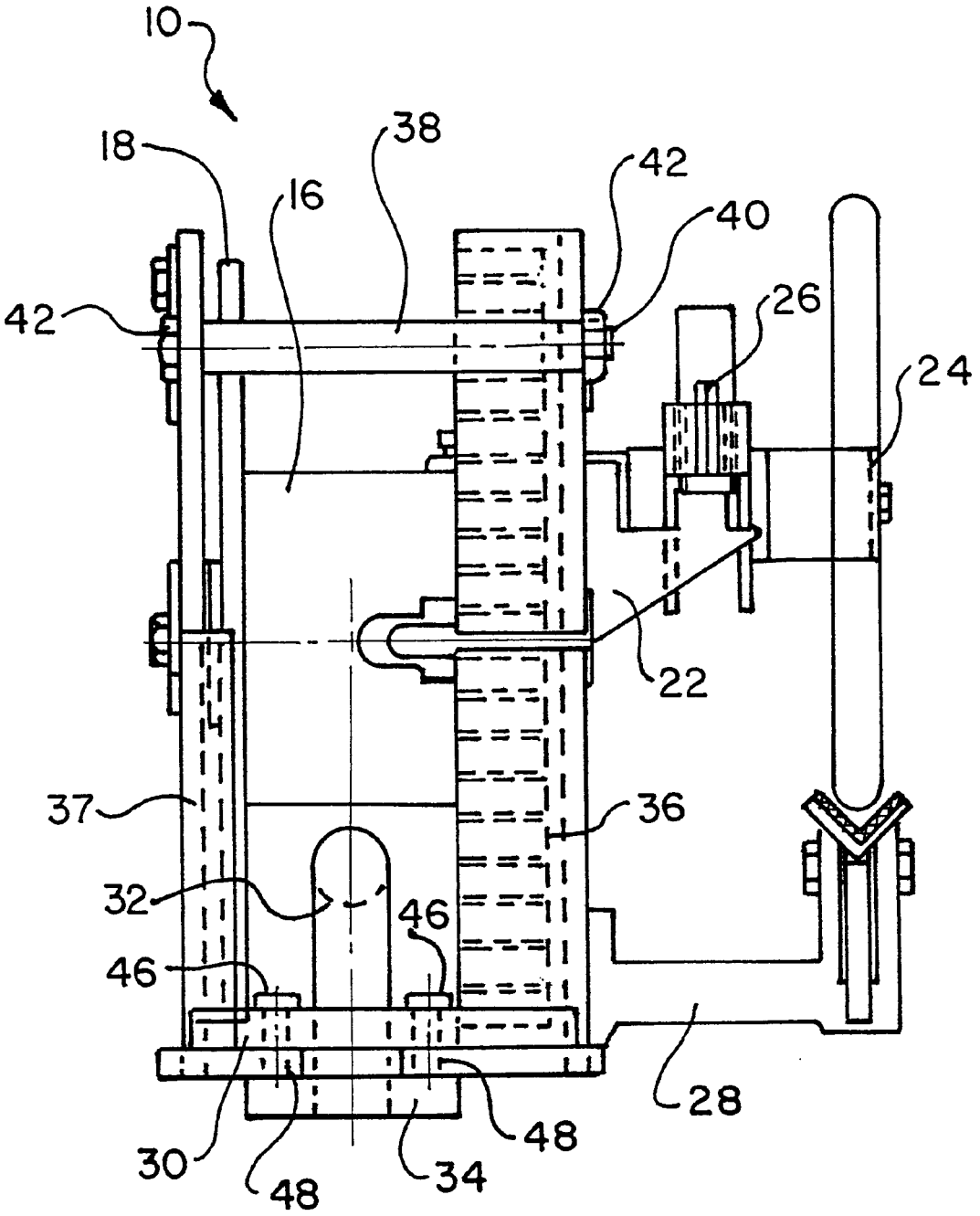
FIG. 2 PRIOR ART
FIG. 2 is a front view of the manual swivel winch illustrated in FIG. 1.
Figure 3:
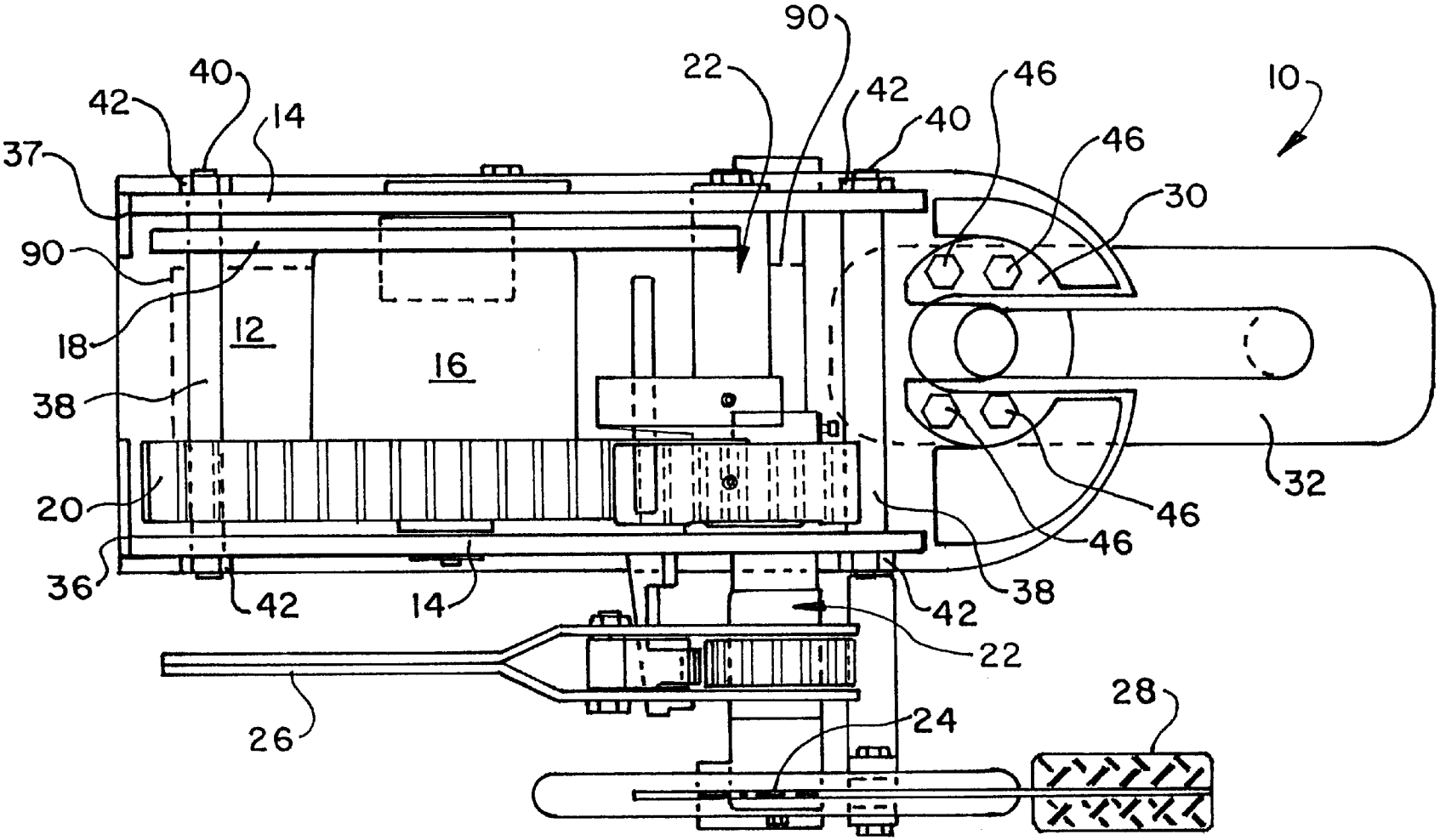
FIG. 3 PRIOR ART
FIG. 3 is a plan view of the manual swivel winch illustrated in FIG. 1.
Figure 4:
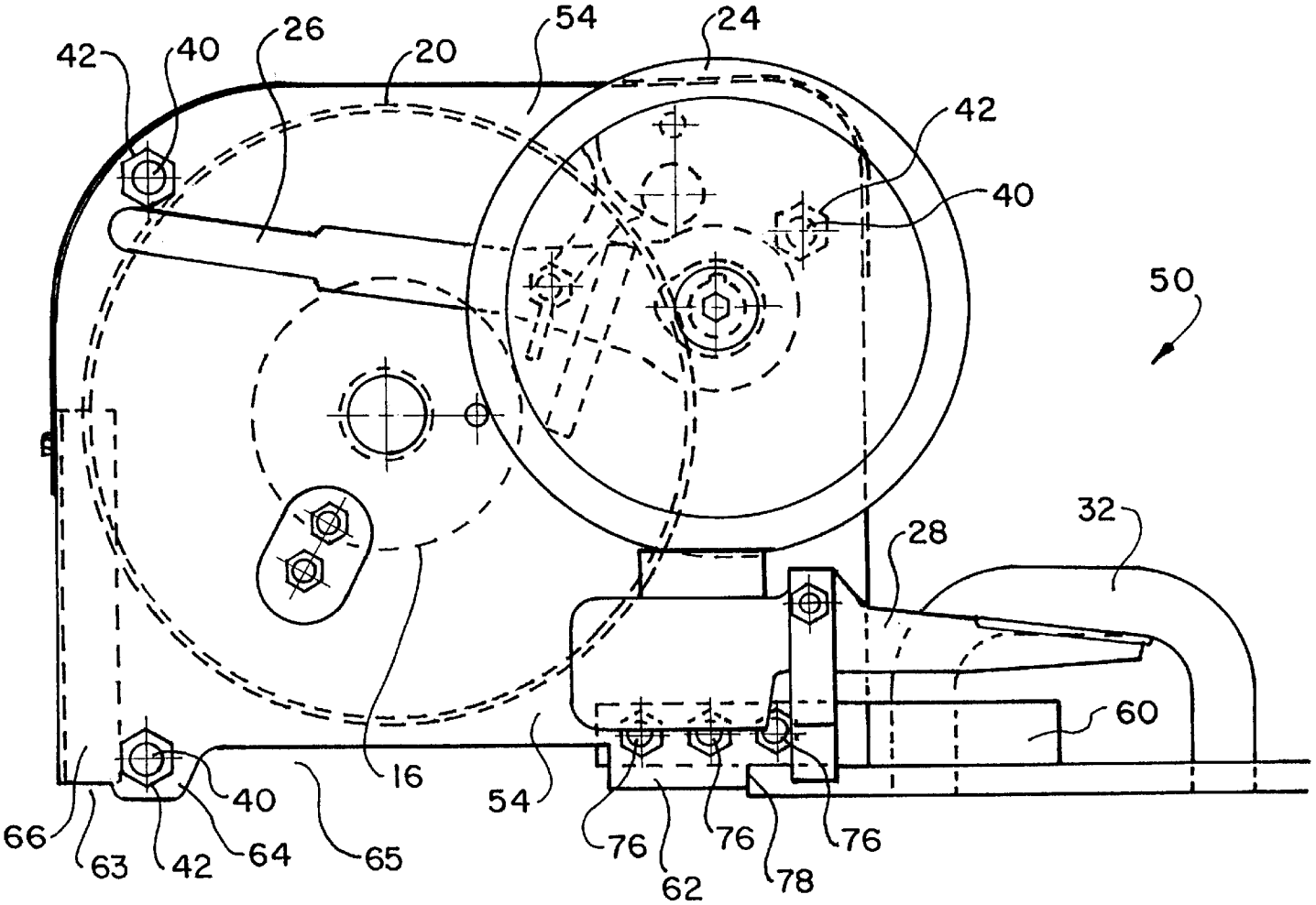
FIG. 4 is a side view of a manual swivel winch according to the present invention.
Figure 5:
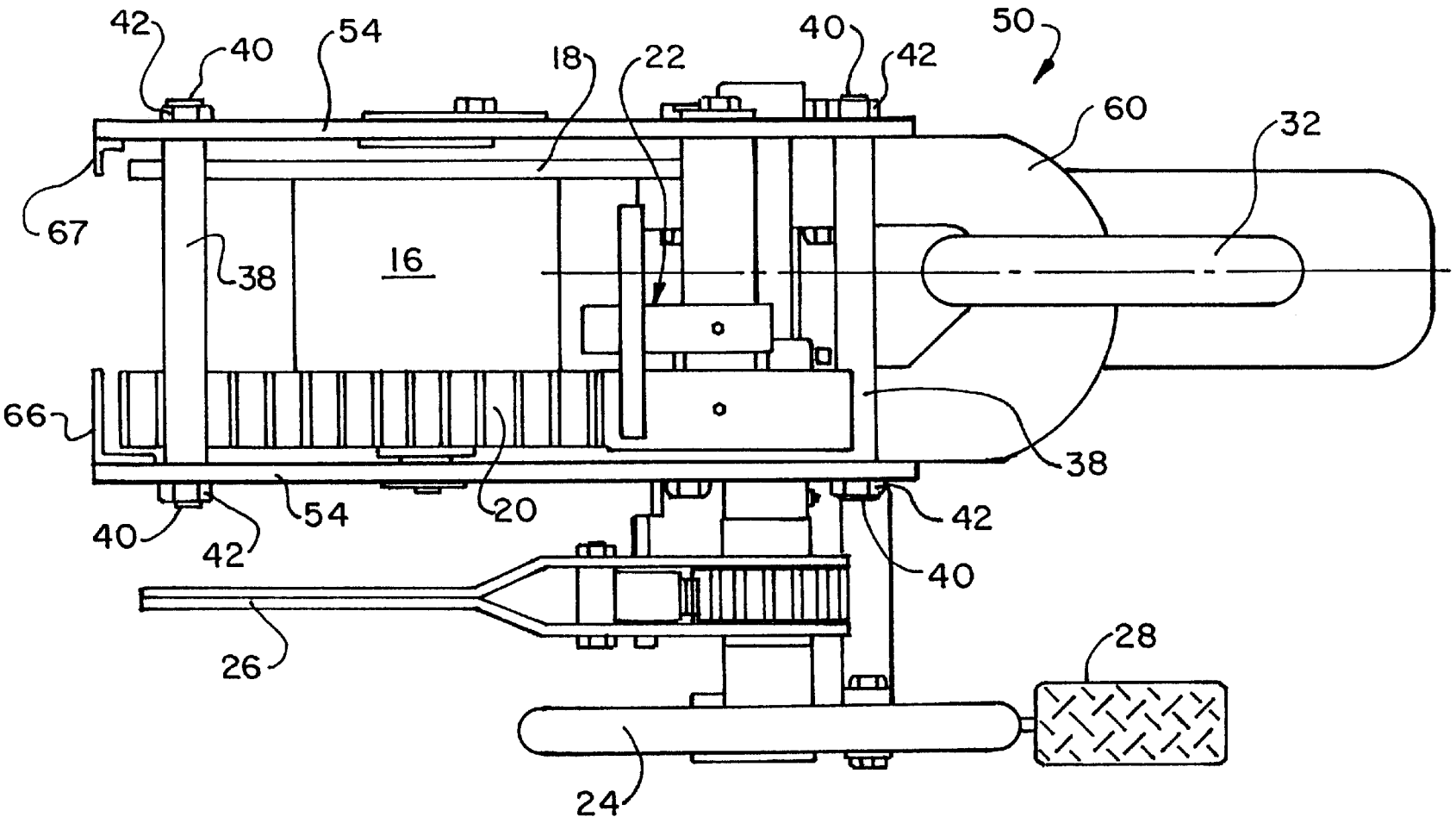
FIG. 5 is a plan view of the manual swivel winch illustrated in FIG. 4.
Figure 6:
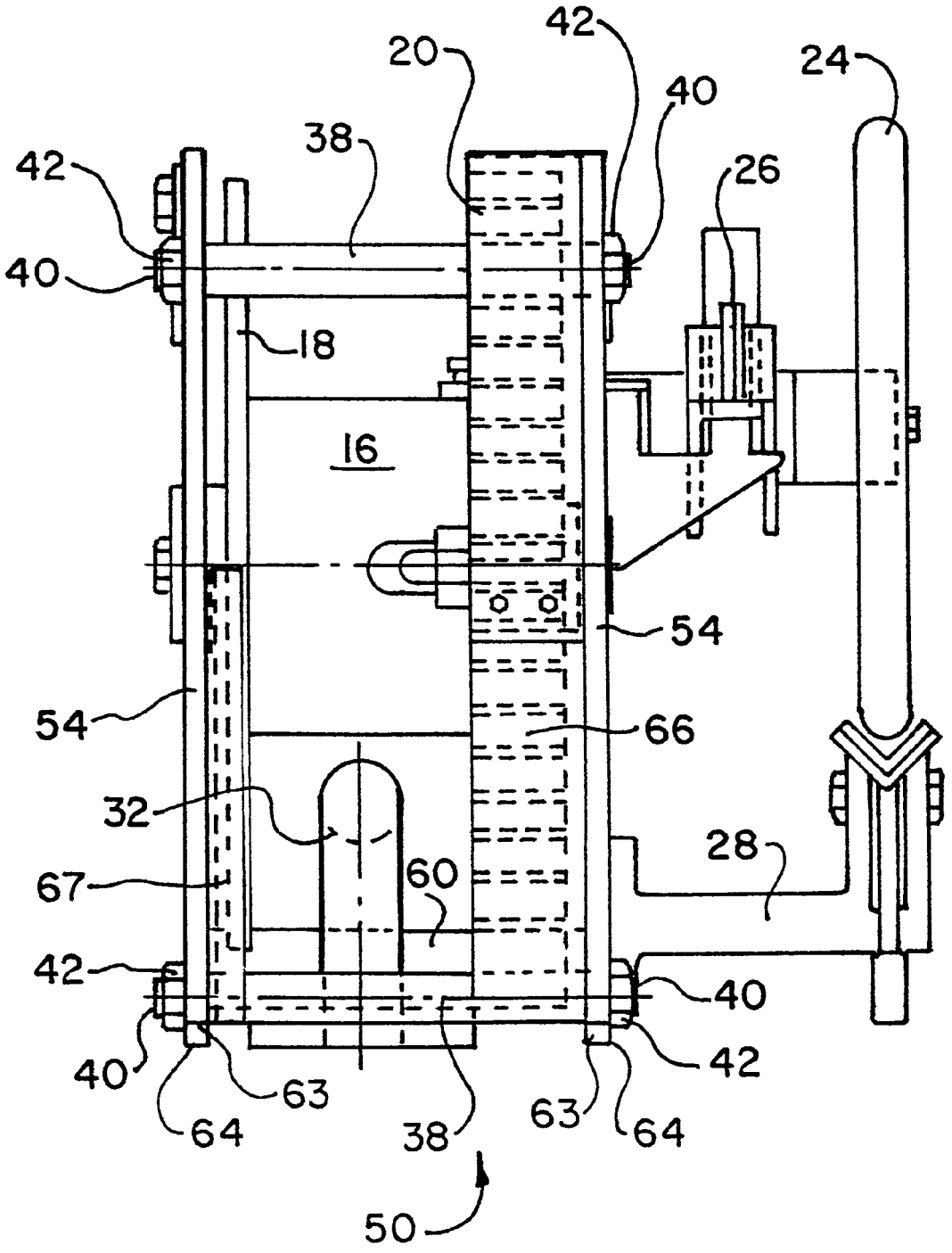
FIG. 6 is a front view of the manual swivel winch illustrated in FIG. 4.

The side plates 54 are maintained spaced from each other by three spacers 38 having the associated bolts 40 and attaching nuts 42, and the swivel link 60 which is attached to the side plates 54, as will be described hereinafter. Two of the tubular spacers 38 are positioned in the same locations as the winch 10 illustrated in FIGS. 1–3, one spacer 38 in the upper front portion of the winch 50 and the other spacer 38 in the upper rear portion of the winch 50. The third spacer 38 is provided in the lower front portion of the side plate 54 of the winch 10 generally where the front foot 64 is formed in each of the side plates 54. The third spacer 38 is essentially aligned with the front feet 64 of the side plates 54. The specific construction, number and location of the spacers 38 can vary within the scope of the present invention. The swivel link 60 forms the remaining spacing element in the winch 50 and is illustrated in better detail in FIGS. 7 and 8.

Figure 8:
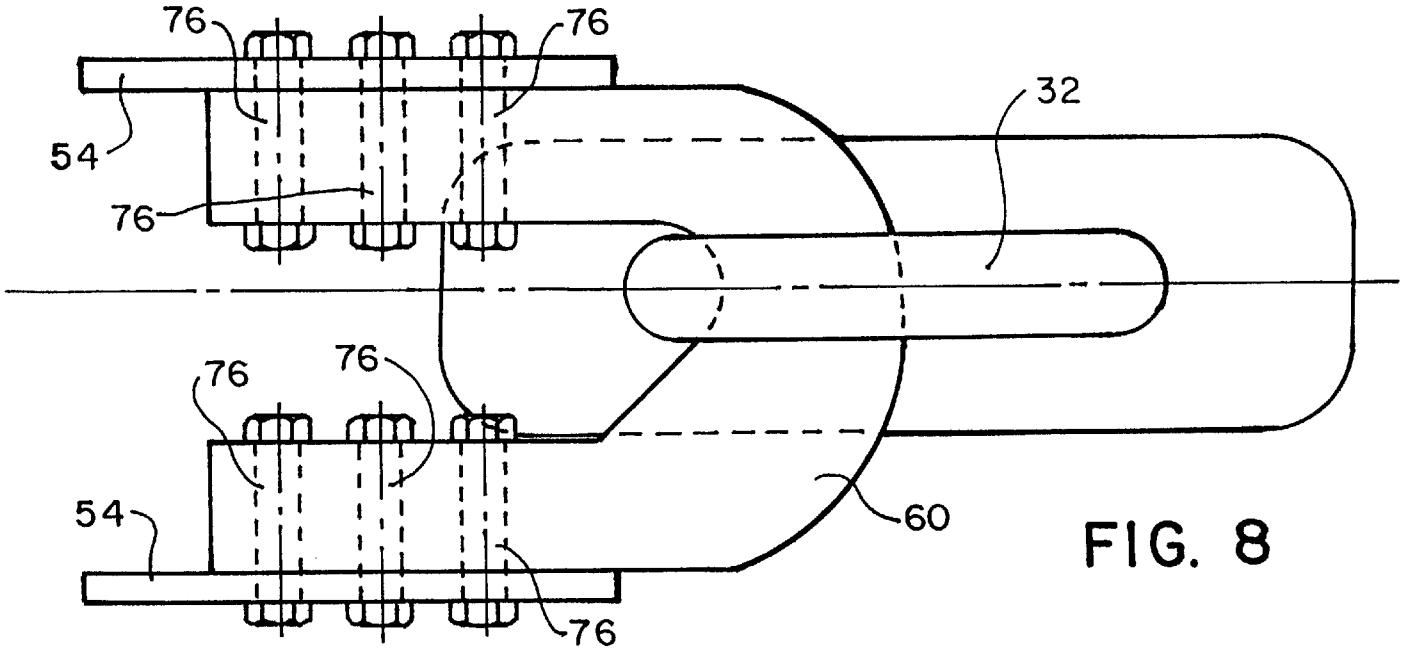
FIG. 8 is a plan view of the swivel link illustrated in FIG. 7.
Figure 7:
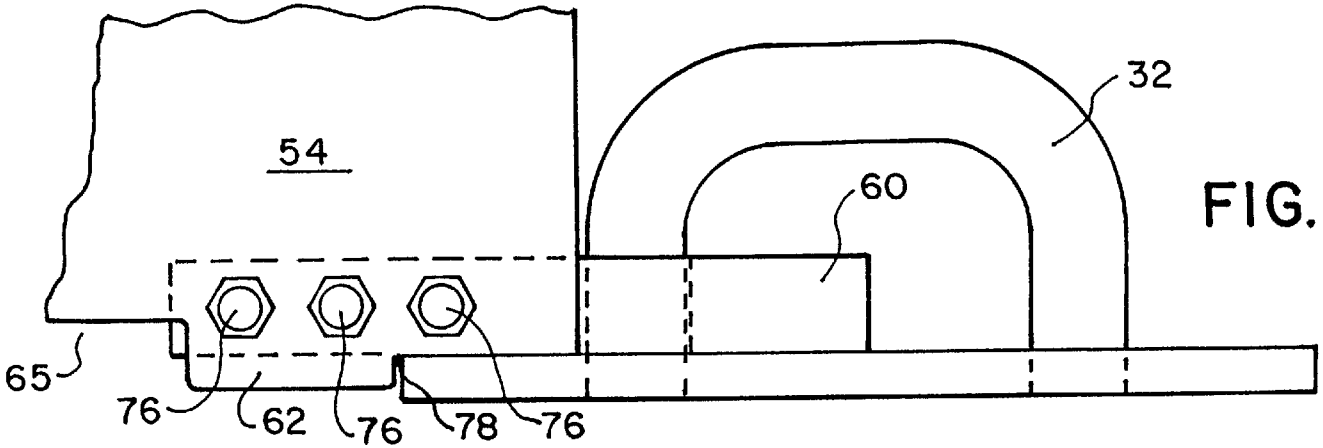
FIG. 7 is a side view of a swivel link of the manual swivel winch illustrated in FIG. 4.

The swivel link 60 is generally formed as an off-center U which will maintain the pivotal attachment of the winch 50 to the D-ring 32 along the centerline of the drum 16 as shown in FIGS. 7 and 8. The swivel link 60 is attached directly to the side plates 54 by a plurality of through bolts 76 which extend through aligned holes in the swivel link 60 and the adjacent side plate 54 as shown in FIGS. 7 and 8. The rear foot 62 of each side plate 54 also provides sufficient material support to the side plate 54 for the attachment of the swivel link 60. A cutout 78 is provided behind each rear foot 62 extending to the rear of the side plate 54. The cutouts 78 allow the winch 50 to pivot about the D-ring 32. Attaching nuts thread onto the bolts 76 to secure the bolts 67.

The winch 50 of the present design provides a number of improvements over the prior art winch 10 in the manufacturing process and in operation. In operation, the open bottom structure defined by the side plates 54 (provided by the elimination of a base plate) taken in combination with the recesses 65 in each side plate 54 provides a self-cleaning or easy cleaning winch 50. Debris does not collect in the winch 50, instead such debris falls through the open bottom and can be easily removed through the recesses 65 such as by pivoting the winch 50. Alternatively, the open structure of the winch 50 allows the winch 50 to be cleaned by hosing off the winch 50 or the like. A second operational benefit is provided by the three-quarter rear foot 62 of each side plate 54. The rear feet 62 are used in mounting of the winch 50 onto the D-ring 32. The rear feet 62 minimize the distance which the rear of the winch 50 must be elevated to mount the winch 50 onto the D-ring 32. As shown in the figures, after the winch 50 is mounted on the D-ring 32, the rear feet 62 generally do not support the winch 50.

The elimination of a base or bottom plate saves material costs in constructing the winch 50. To a lesser extent, the provision of each recess 65, each cutout 63 and each cutout 78 also saves material costs, as does the use of three spacers 38 instead of four. In addition to the operational and capital saving benefits discussed above, the minimizing of the labor associated with manufacturing the winch 50 represents significant advantages. These labor-saving advantages of the present design include the elimination of the base plate which saves a significant amount of heavy welding. Further, in the present design only three spacers 38 need to be installed and the third spacer 38 (aligned with the front feet 64) is not removed saving further manufacturing time. The attachment of the swivel link 60 is by through bolts 76 which do not require tapping of the holes in the side plates 54. Additionally, with the present design the gear guard 66 and the flange guard 67 can be formed as appropriately sized angle irons which are quickly tack welded into place. The cutouts 63 serve to locate the gear guard 66 and the flange guard 67, minimizing the assembly time since no measurement is required. These features combine to provide a cost effective, easily manufactured winch 50 which provides several operational advantages. The gear guard 66 and flange guard 67 may also be formed as appropriately sized C-channels which will provide a greater side area for the cable to ride against.

The improvements in the winch 50 essentially relate to a new housing design. The design of the housing of the winch 50 can be used in any size of winch. For example, conventional winch sizes include 5, 10, 15, 20, 30, 40, 50, 60, 65, and 75 ton winches, any of which could utilize the design of winch 50 of the present invention.

The present invention also includes the modification of existing winches 10 to accomplish some of the advantages of the winch 50 of the present invention. Specifically, one or more holes may be cut into the base plate 12 such as by cutting along phantom line 90 shown in FIG. 3. The provision of the one or more holes in the base plate 12 will provide a substantially open bottom to the modified winch 10 similar to the winch 50. The one or more holes in the base plate 12 must be sufficiently sized and numbered to allow debris to easily pass therethrough. Consequently, there is no specific definition for what constitutes a substantially open bottom. However, it is anticipated that at least 50% of the base plate 12 will be open in the modified winch 10. In the winch 50, only a spacer 38 and swivel link 60 are near the bottom between the side plates 54, such that the percentage of open space in the substantially open bottom is significantly greater.

Although the present invention has been described with particularity herein, the scope of the present invention is not limited to the specific embodiment disclosed. It will be apparent to those of ordinary skill in the art that various modifications may be made to the present invention without departing from the spirit and scope thereof. The scope of the present invention is defined in the appended claims and equivalents thereto.

What is claimed is:

1. A manual swivel winch comprising:

a pair of spaced side plates defining a substantially open bottom, said side plates at least partially supporting said winch during operation of said winch;

a drum rotatably supported between said side plates;

a means attached to said drum for rotation of said drum; and a swivel link attached to said side plates and adapted to pivotally attach said winch to a D-ring, wherein a portion of said swivel link attached to said side plates is formed in a U-shape in plan view.

2. The manual swivel winch of claim 1 wherein each said side plate includes a pair of spaced feet extending down at a lower edge thereof.

3. The manual swivel winch of claim 2 wherein each said side plate includes a recess extending between said pair of feet.

4. The manual swivel winch of claim 3 wherein one of said pair of feet of each said side plate extends lower than the other of said pair of feet of said side plate.

5. The manual swivel winch of claim 1 wherein said swivel link is bolted to said side plates, and said swivel link is an off-center U-shape in plan view.

6. The manual swivel winch of claim 1 further including a plurality of spacers, wherein said side plates are spaced from each other by a plurality of spacers and said swivel link, wherein each said side plate includes a pair of spaced feet extending down at a lower edge thereof, and wherein one of said spacers is aligned with one of said pair of feet of each said side plate.

7. A manual swivel winch comprising:

a pair of spaced side plates defining a substantially open bottom, said side plates at least partially supporting said winch during operation of said winch;

a drum rotatably supported between said side plates;

a means attached to said drum for rotation of said drum;

a swivel link attached to said side plates and adapted to pivotally attached said winch to a D-ring; and an angle iron extending along one edge of each said side plate, each said angle iron forming a guard for said winch.

8. The manual swivel winch of claim 7 wherein each said side plate includes a pair of spaced feet extending down at a lower edge thereof, and wherein each said side plate includes a cutout extending to an edge of said side plate, said cutout adapted to receive a portion of a D-ring therein during pivoting of said winch.

9. A housing for a manual swivel winch, said housing comprising:

a pair of spaced side plates defining a substantially open bottom, said pair of side plates adapted to rotatably support a drum therebetween and at least partially supporting said winch during operation of said winch; and a swivel link attached to said side plates and adapted to pivotally attach said winch to a D-ring, wherein a portion of said swivel link attached to said side plates is formed in a U-shape in plan view.

10. The manual swivel winch housing of claim 9 wherein said side plates are spaced from each other by a plurality of spacers and said swivel link.

11. A housing for a manual swivel winch said housing comprising:

a pair of spaced side plates defining a substantially open bottom, said pair of side plates adapted to rotatable support a drum therebetween and at least partially supporting said winch during operation of said winch, wherein each said side plate includes a pair of spaced feet extending down at a lower edge thereof, and a recess extending between said pair of feet; and a swivel link attached to said side plates and adapted to pivotally attach said winch to a D-ring.

12. The manual swivel winch housing of claim 11 wherein each of said side plates includes a cutout extending to an edge of said side plate, said cutout adapted to receive a portion of a D-ring therein during pivoting of said winch, and wherein said swivel link is an off-center U-shape in plan view.

13. A manual swivel winch comprising:

a housing having a substantially open bottom and a pair of spaced side plates on opposed sides of said substantially open bottom;

a drum rotatably supported within said housing;

a rotatable handle attached to said drum and extending from said housing for operating said drum; and a swivel link attached to said side plates and adapted to pivotally attach said winch to a D-ring, wherein a portion of said swivel link attached to said side plates is formed of a U-shape in plan view.

14. The manual swivel winch of claim 13 wherein said swivel link is bolted to said side plates.

15. The manual swivel winch of claim 13 wherein each of said side plates includes a cutout extending to an edge of said side plate, said cutout adapted to receive a portion of a D-ring therein during pivoting of said winch, and wherein said swivel link is an off-center U-shape in plan view.

16. A manual swivel winch comprising:

a housing having a substantially open bottom and a pair of spaced side plates on opposed sides of said substantially open bottom, wherein each said side plate includes a pair of spaced feet and a recess extending between said pair of feet;

a drum rotatably supported within said housing;

a rotatable handle attached to said drum and extending from said housing for operating said drum; and a swivel link attached to said side plates and adapted to pivotally attach said winch to a D-ring.

17. The manual swivel winch of claim 16 wherein said side plates are spaced from each other by a plurality of spacers and said swivel link, and wherein one said spacer is aligned with one of said pair of feet of each said side plate.

18. The manual swivel winch of claim 16 further including an angle iron extending along one edge of each said side plate, each said angle iron forming a guard for said winch.

* * * * *

UNITED STATES PATENT AND TRADEMARK OFFICE

CERTIFICATE OF CORRECTION

PATENT NO. : 5,947,450

DATED : September 7, 1999

INVENTOR(S) : David B. Grapes

It is certified that error appears in the above-identified patent and that said Letters Patent is hereby corrected as shown below:

Column 4 Line 28 "bolts 67" should read --bolts 76--.

Column 6 Lines 38-39, claim 11, "to rotatable support" should read --to rotatably support--.

Signed and Sealed this

Sixth Day of June, 2000

*Attest:*

Q. TODD DICKINSON

*Attesting Officer*

*Director of Patents and Trademarks*